US007249575B2

(12) United States Patent
Pottie et al.

(10) Patent No.: US 7,249,575 B2
(45) Date of Patent: Jul. 31, 2007

(54) THERMOSTAT-CONTROLLED REGULATION VALVE FOR A FLUID AND COOLING CIRCUIT INCLUDING SUCH A VALVE

(75) Inventors: Nicolas Pottie, Sainte Genevieve des Bois (FR); Alain Bernard Armand Bouloy, Etrechy (FR)

(73) Assignee: Vernet, Ollainville (FR)

( * ) Notice: Subject to any disclaimer, the term of this patent is extended or adjusted under 35 U.S.C. 154(b) by 0 days.

(21) Appl. No.: 11/313,271

(22) Filed: Dec. 21, 2005

(65) Prior Publication Data

US 2006/0130778 A1 Jun. 22, 2006

(30) Foreign Application Priority Data

Dec. 21, 2004 (FR) ..... 04 13672

(51) Int. Cl.
*F01P 7/14* (2006.01)
*F02M 25/07* (2006.01)

(52) U.S. Cl. ..... 123/41.1; 123/568.12

(58) Field of Classification Search ..... 123/41.1, 123/41.51, 41.08, 41.09, 568.12; 236/34.5
See application file for complete search history.

(56) References Cited

U.S. PATENT DOCUMENTS 4,520,767 A * 6/1985 Roettgen et al. ..... 123/41.1
4,621,594 A 11/1986 Kubis
5,353,757 A 10/1994 Susa et al.

FOREIGN PATENT DOCUMENTS

| | | |
|---|---|---|
| DE | 2755465 | 6/1979 |
| DE | 10143091 | 3/2003 |
| FR | 2844041 | 3/2004 |
| WO | 9418479 | 8/1994 |

* cited by examiner

*Primary Examiner*—Tony M. Argenbright
*Assistant Examiner*—Hyder Ali
(74) *Attorney, Agent, or Firm*—Dowell & Dowell P.C.

(57) ABSTRACT

The housing of this valve delimits a chamber inside the housing, the chamber including a first fluid inlet at a first temperature, a second fluid inlet at a second temperature, and a first fluid outlet and a second fluid outlet through which fluid can freely communicate with the first and second inlets respectively. Thermostat-controlled means for controlling fluid circulation through the valve are provided, so that fluid can freely pass through the chamber between the first inlet and the second outlet and between the second inlet and the first outlet, only when either the value of the first temperature is less than a first predetermined threshold value, or the value of the second temperature is greater than a second predetermined threshold value strictly greater than the first threshold value.

10 Claims, 6 Drawing Sheets

THERMOSTAT-CONTROLLED REGULATION VALVE FOR A FLUID AND COOLING CIRCUIT INCLUDING SUCH A VALVE

BACKGROUND OF THE INVENTION

1. Field of the Invention

This invention relates to a thermostat-controlled fluid regulation valve and a circuit for cooling an internal combustion engine and a system recirculating exhaust gases from this engine, comprising such a valve.

2. Description of the Related Art

This type of valve is used to distribute fluid entering the valve to different outlet channels as a function of the temperature of the inlet fluid, in many applications in the fluids domain, particularly for cooling internal combustion engines used in vehicles. Thus conventionally, a valve may be used on the upstream side of a radiator designed to dissipate excess heat in a cooling fluid from an engine to be cooled, to control cooling by the radiator of the fluid entering the valve when this fluid becomes hot, and to control faster cooling of the fluid by the radiator when the temperature of the inlet fluid increases above a given predefined threshold value. The valve is provided with a thermostat-controlled element containing an expendable material such as wax to control regulation of the fluid flow through the valve.

Furthermore, for reasons related to protection of the environment, thermal combustion engines are increasingly used in association with an "EGR" (Exhaust Gas Recirculation) system. This system is an antipollution device that injects a proportion of exhaust gases from the engine into the intake manifold of this engine, to reduce combustion temperature peaks and therefore the formation of nitrogen oxides. Before injecting exhaust gases into the engine intake manifold, they have to be cooled using a cooling fluid that advantageously circulates in the same circuit as the engine cooling circuit, particularly in the radiator designed to dissipate excess heat from the cooling fluid. When the engine starts, it is desirable that the cooling fluid should be cooled more intensively than during the rest of the running time of the engine so that the injected exhaust gases are as cold as possible, to avoid injecting exhaust gases significantly hotter than the engine intake manifold into the manifold and thus enable a more uniform increase in the engine temperature. The cooling fluid used in the EGR system may be regulated by a thermostat-controlled valve placed on the upstream side of the above-mentioned radiator.

However, the presence of two separate valves immediately on the upstream side of the radiator, namely the fluid regulation valve related to the thermal combustion engine and the fluid regulation valve related to the EGR system, introduces dimensional problems. Furthermore, it usually means that the radiator is oversized since in practice the radiator comprises a first part designed for heat exchange of the fluid from the engine and a second part designed for heat exchange of the fluid from the EGR system, each part of the radiator being sized independently of the other as a function of maximum cooling needs firstly for the engine to be cooled and secondly for the EGR system.

SUMMARY OF THE INVENTION

The purpose of this invention is to propose a thermostat-controlled valve designed to regulate circulation of a cooling fluid both for a thermal combustion engine and for an EGR system to be cooled, minimising the size of a common radiator to which fluid outlet from the valve is directed.

To achieve this, the purpose of the invention is a thermostat-controlled fluid regulation valve, comprising:

- a housing delimiting a fluid circulation chamber inside the housing, the fluid chamber including a first fluid inlet at a first temperature, a second fluid inlet at a second temperature, and a first fluid outlet and a second fluid outlet through which fluid can freely communicate with the first and second inlets respectively, independently of the first and second temperatures, and
- thermostat-controlled means for controlling fluid circulation through the chamber, adapted firstly so that fluid can freely pass through the chamber between the first inlet and the second outlet and between the second inlet and the first outlet when either the value of the first temperature is less than a first predetermined threshold value, or the value of the second temperature is greater than a second predetermined threshold value strictly greater than the first threshold value, and secondly to prevent fluid from circulating through the chamber between the first inlet and the second outlet and between the second inlet and the first outlet when the value of the first temperature is greater than the first threshold value and also the value of the second temperature is less than the second threshold value.

According to the invention, the functions of the two valves designed separately in prior art are combined in a single thermostat-controlled valve. The valve according to the invention can act on a first fluid channel carrying fluid circulating freely between the first inlet and the first outlet delimited by the valve casing and on a second fluid channel carrying fluid circulating between the second inlet and the second outlet of the casing. As long as the value of the fluid temperature to be regulated by the valve is inconsistent, in other words more precisely when the temperature of the fluid circulating in the first channel is greater than the first predetermined threshold value and the temperature of the fluid circulating in the second channel is less than the second predetermined threshold value, the two fluid flow channels circulate separately from each other through the valve without mixing. On the other hand when the temperature of the fluid in the first channel is less than the first threshold value, or when the temperature of the fluid in the second channel is greater than the second threshold value, in other words in practice when a thermal combustion engine to be cooled by a cooling circuit equipped with the valve according to the invention is either in the warming up phase immediately after starting, or when a high load is applied to it, the two fluid channels mentioned above mix and the fluid outlet from the valve is directed to the two outlets from the casing independently of the channel from which they arrive. In other words, by arranging a radiator at the outlet from the valve according to the invention, the heat exchange with the fluid in the radiator is increased both at low temperature, in other words during the engine starting phase during which the exhaust gases from the engine should advantageously be cooled more intensely in the EGR system through which the fluid passes, or at high temperature, in other words when the engine to be cooled by the fluid is operating under a high load.

According to other characteristics of this valve considered separately or in any technically possible combination:

- the thermostat-controlled means comprise two thermostat-controlled elements each comprising a body that contains an expandable material and a piston free to move with respect to the body under the effect of expansion of the material contained in the body, the body of a first of the two thermostat-controlled elements being arranged on the flow path of the fluid in the chamber between the first inlet and the first outlet, while the body of the second thermostat-controlled element is arranged on the flow path of the fluid in the chamber between the second inlet and the second outlet;

each thermostat-controlled element carries a closer closing off the fluid passage through the chamber, the closer of the first thermostat-controlled element being associated with a seat rigidly connected to the housing while the closer of the second thermostat-controlled element is associated with another seat carried by the closer of the first thermostat-controlled element;

the closer of the first thermostat-controlled element comprises a tubular sleeve around which fluid circulates when the value of the first temperature is strictly less than the first threshold value and inside which fluid circulates when the value of the second temperature is greater than the second threshold value;

the closer of the second thermostat-controlled element comprises a valve disk adapted to bear on one of the end edges of the tubular sleeve;

the body of the first thermostat-controlled element is fixed with respect to the housing, the closer carried by this first thermostat-controlled element being moved by its piston and in that the closer carried by the second thermostat-controlled element is fixed to the body of the second thermostat-controlled element, the position of the piston of this second thermostat-controlled element with respect to the housing being controlled by the piston of the first thermostat-controlled element;

the closer of the first thermostat-controlled element is provided with a means of supporting the free end of each piston of the first and second thermostat-controlled elements;

the valve comprises a single elastic device for pulling the body towards the piston of each thermostat-controlled element, this elastic device being adapted to force the closer carried by the second thermostat-controlled element in contact with its associated seat when the value of the second temperature is less than the second threshold value.

Another purpose of the invention relates to a cooling circuit for an internal combustion engine and a recirculation system for exhaust gases output from this engine, comprising a thermostat-controlled fluid regulation valve for the circuit, such as defined above, and a radiator comprising a cooling body that delimits:

a first inlet connected to the first inlet of the valve and adapted to be supplied with fluid from the exhaust gases recirculation system, and a second inlet connected to the second inlet of the valve and adapted to be supplied with fluid from the thermal combustion engine, a fluid exhaust outlet, a first compartment for heat exchange with the fluid, opening up on the downstream side in the exhaust outlet and connected on the upstream side to the first outlet of the valve, and a second compartment for heat exchange with the fluid, separated from the first compartment by a cooling partition, opening up on the downstream side in the exhaust outlet and connected on the upstream side to the second outlet of the valve.

According to an advantageous characteristic of this cooling circuit, the housing of the valve is integrated inside the body of the radiator, and in particular is integral with at least a part of this body.

BRIEF DESCRIPTION OF THE DRAWINGS

The invention will be better understood after reading the following description given solely as an example and with reference to the drawings on which.

DESCRIPTION OF THE PREFERRED EMBODIMENTS

Figure 1:
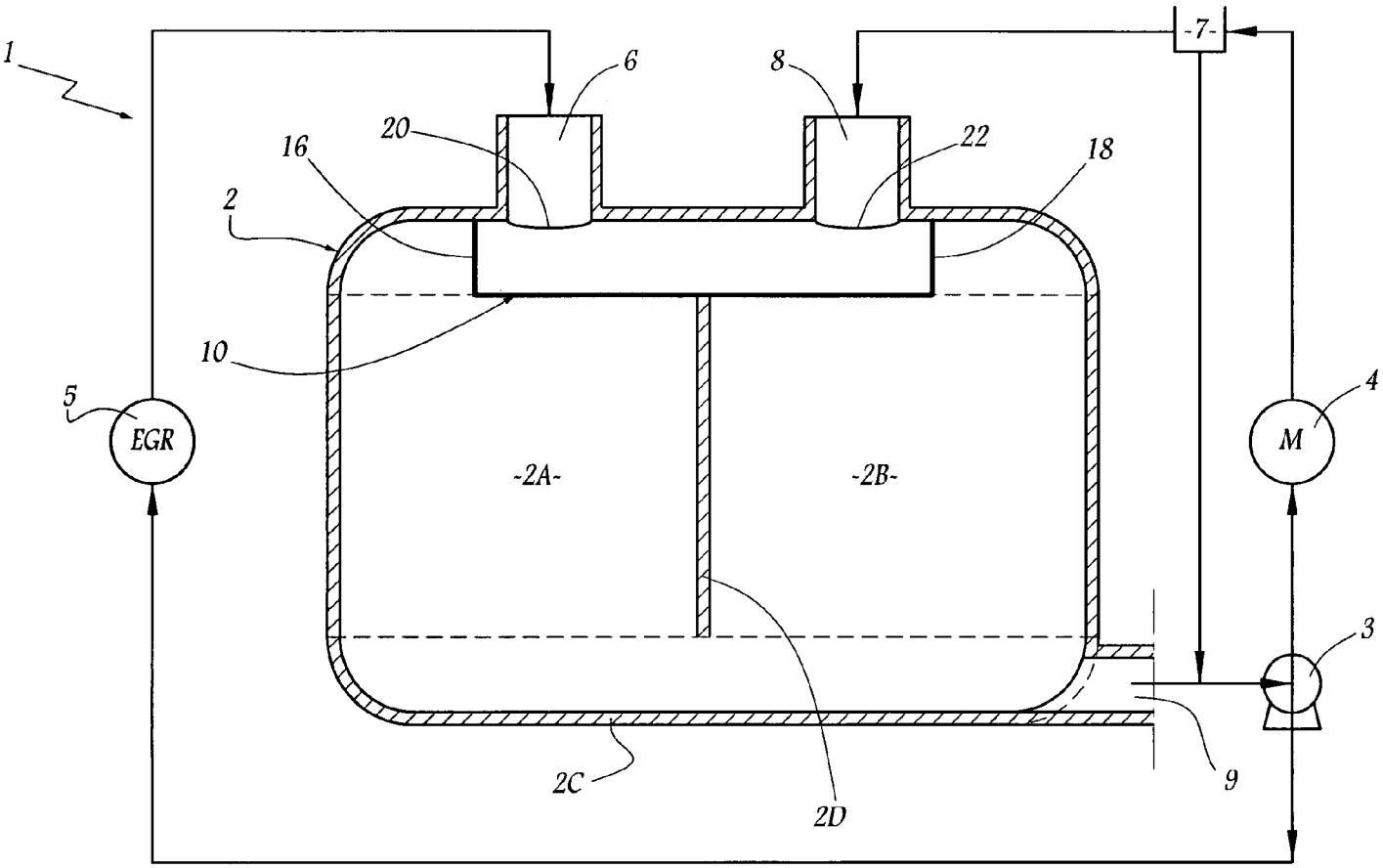
FIG. 1 is a diagrammatic view of a cooling circuit according to the invention.

FIG. 1 shows a cooling fluid circulation circuit 1 comprising a radiator 2 designed to evacuate excess heat from the cooling fluid passing through it and a pump 3 designed to circulate the fluid in the circuit. The circuit 1 is associated with a thermal combustion engine 4 to be cooled and an exhaust gas recirculation system 5 to be cooled. As explained above, the system 5, usually called the EGR system, is an anti-pollution device that injects part of exhaust gases from the engine 4 into the intake manifold of this engine to reduce combustion temperature peaks and consequently the formation of nitrogen oxides.

During operation, the pump 3 discharges cooling fluid both to the EGR system 5 and to the engine 4 to cool them. After having circulated fluid in the system 5, the circuit 1 sends fluid to an inlet 6 to the radiator 2. Similarly, after cooling the engine 4, the fluid is sent through the circuit 1 to a regulation valve 7 that sends the fluid inlet into this valve directly to the pump 3, and/or to the radiator 2, at an inlet 8 separate from the inlet 6. Conventionally, the valve 7 controls regulation of the fluid supplying it as a function of the temperature of the fluid, the fluid being sent to the radiator only if its temperature is too high to assure effective cooling of the engine 4. For a thermal combustion engine of an automobile vehicle, the valve 7 sends the fluid from the engine 4 to the radiator 2 when its temperature exceeds about 80 to 90° C.

The fluid inlet at the inlets 6 and 8 of the radiator 2 supplies two separate compartments 2A and 2B delimited inside the cooling body 2C of this radiator and separated from each other by a sealed partition 2D for heat exchange with the outside. Consequently, the radiator 2 is equipped with a valve 10 designed to regulate fluid flow between firstly the inlets 6 and 8 and secondly compartments 2A and 2B as explained below. The fluid is directed to the outside of the body 2C of the radiator 2 on the downstream side of each compartment, at a common intake outlet 9 connected to the pump 3.

Details of the regulation valve 10 arranged between inlets 6 and 8 and compartments 2A and 2B of the radiator 2 are shown in FIGS. 2, 3A, 4A, 5A and 6A. The valve 10 comprises an outer casing 12 that is globally tubular with a longitudinal axis X-X and for example has a generally U-shaped cross section, open towards the direction of the reader looking at FIG. 2. The casing 12 is entirely integrated inside the body 2C of the radiator 2 extending through the partition 2D on the side of the radiator inlets 6 and 8. The casing 12 thus internally delimits an elongated fluid circulation chamber 14 in its typical part between its longitudinal ends 16 and 18 that open up freely into compartments 2A and 2B respectively and thus form fluid outlets connected to these compartments, for the valve 10. The typical part of the chamber 14 is designed to be supplied with fluid at the two inlets 20 and 22 arranged one behind the other along the X-X axis and connected to the inlets 6 and 8 respectively of the radiator 2.

The casing 12 is arranged and is sealed inside the body 2C of the radiator 2 such that on the upstream side of these compartments, fluid circulation between compartments 2A and 2B within the radiator is only possible through the chamber 14, apart from any leaks. For example, the casing 12 is integral with the separation partition 2D and the pipes of the body 2C delimiting inputs 6 and 8.

The fluid flow through the chamber 14 is regulated by a thermostat-controlled assembly 24 described in detail below. This assembly acts on the fluid flow in the axial part of the chamber 14 located between the inlets 20 and 22, depending on the temperatures of the fluid inlet into the chamber through inlets 20 and 22. In other words, the configuration of this assembly has no influence firstly on fluid flow between the inlet 20 and the outlet 16, and secondly on fluid flow between the inlet 22 and the outlet 18, fluid being able to flow freely between each of these inlets 20, 22 and its corresponding outlet 16, 18 through the longitudinal end parts of the chamber 14.

The thermostat-controlled assembly 24 comprises 2 thermostat-controlled elements 26 and 28 held in place with respect to the casing 12 by a rigid stirrup 30, for example made of metal, rigidly connected to the wall of the casing delimiting the chamber 14. Each element 26, 28 is provided with a body 26A, 28A containing an expendable material such as wax and a piston 26B, 28B free to move with respect to the body under the effect of expansion of the material. The thermostat-controlled elements 26 and 28 extend along the X-X axis in length, being coaxial with each other, their pistons 26B, 28B facing towards each other and essentially located along the X-X axis between the inlets 20 and 22 of the casing 12. The temperature-sensitive part of the body 26A of the element 6 is located along the fluid flow path between the inlet 20 and the outlet 16 while the heat-sensitive part of the body 28A of the element 28 is arranged on the fluid flow path between the inlet 22 and the outlet 18.

Figure 2:
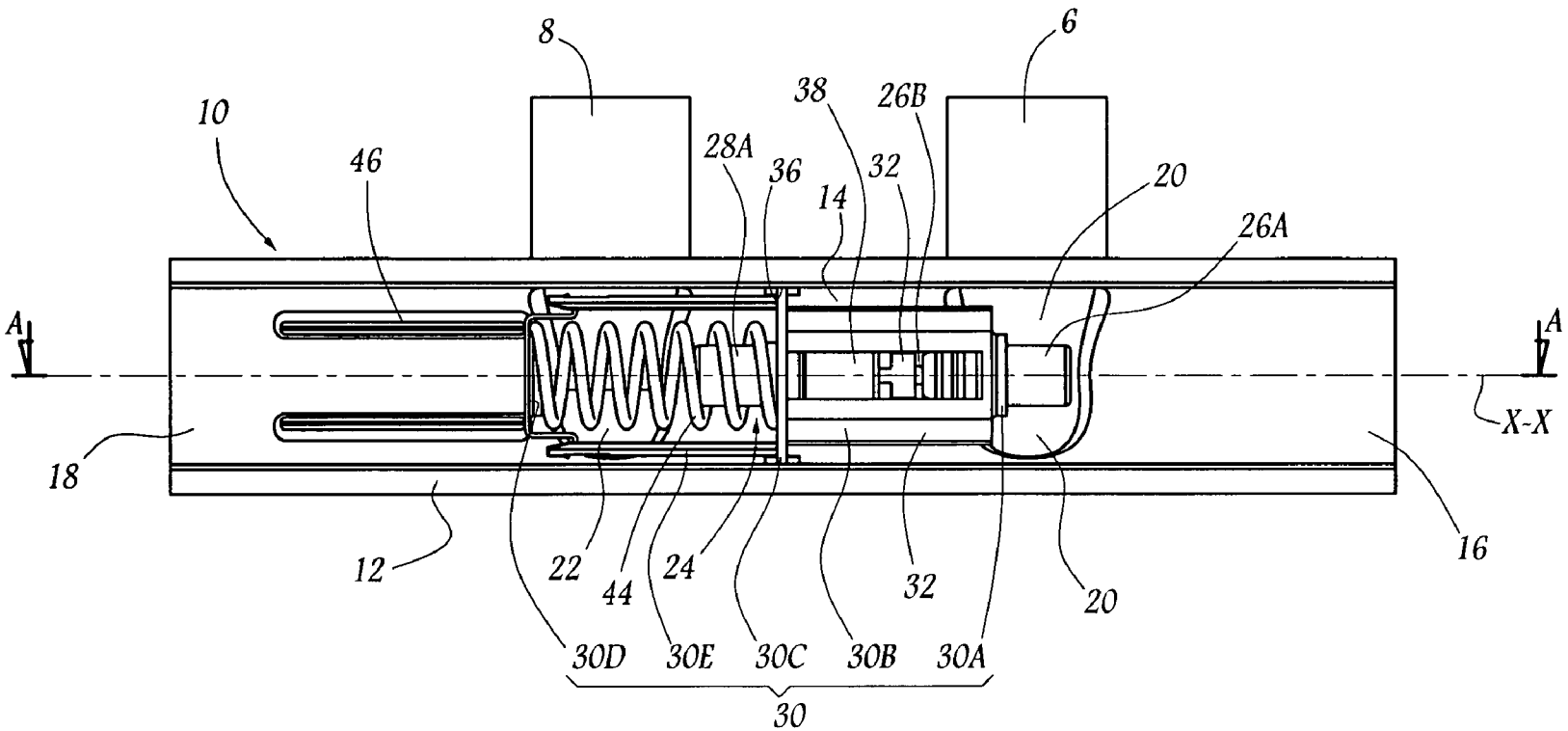
FIG. 2 is an elevation view of a valve according to the invention installed in the circuit in FIG. 1.
Figure 3A:
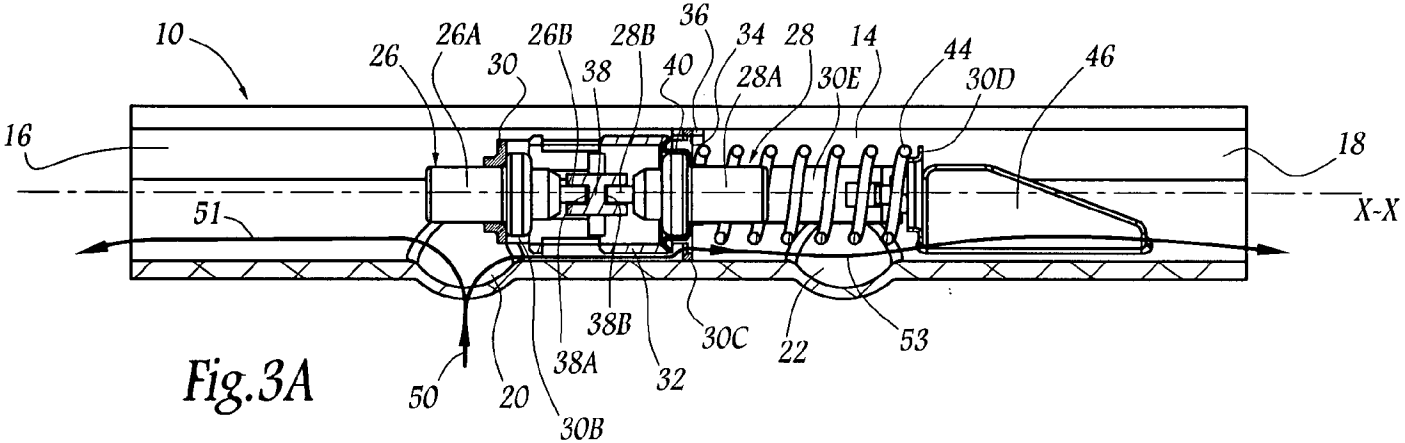
FIGS. 3A, 4A, 5A and 6A are sections along plane A-A in FIG. 2, showing different operating states of the valve.

The body 26A of the thermostat-controlled element 26 is fixed with respect to the casing 12, for example by being force fitted into a fixed annular ring 30A of the stirrup 30, which forms the free end of a pair of rigid arms 30B integral with the stirrup, along a direction parallel to the X-X axis, from a fixed transverse plate 30C of the stirrup along the X-X axis with respect to the casing 12, fitting into slides 36 or similar devices integral with the partition of the casing delimiting the chamber 14. In practice, when the valve 10 is being assembled, the plate 30C is inserted into the slides 36 along the direction of observation in FIG. 2, in other words along a direction perpendicular to the X-X axis and forming part of the longitudinal plane of symmetry of the U-shaped casing 12; once positioned as shown in FIGS. 2 and 3A, the plate 30C axially blocks the remainder of the rigid stirrup 30 with respect to the casing 12 while it can also be designed to retain the plate with respect to the casing along its above-mentioned direction of insertion, for example by a cover or other similar means. The plate 30C has a U-shaped peripheral contour when viewed along the X-X axis, substantially complementary to the internal contour of the cross-section of the casing 12, such that during operation, the plate 30C hermetically divides the chamber 14 into two distinct sub-volumes associated with the thermostat-controlled element 26 and element 28 respectively.

Figure 4A:
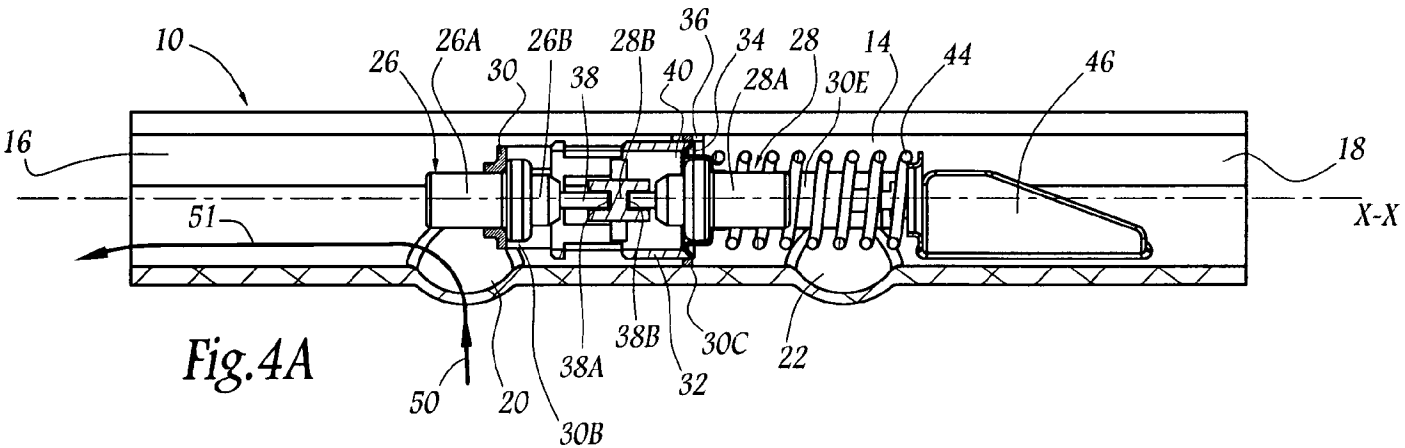

The piston 26B of the element 26 carries a tubular sleeve 32 centred in length on the X-X axis and extending between the arms 30B of the stirrup. The sleeve 32 is sized to bear radially on its outside face in contact with a seat 34 delimited by an opening that passes through the plate 30C of the stirrup 30, and is centred on the X-X axis. During operation, the sleeve 32 is designed to slide axially along the X-X axis so that it extends in the axial direction remote from the seating 34 to enable free fluid circulation through the seat, around the sleeve 32 as shown in FIG. 3A, or it closes off this seat by applying radial thrust as shown in FIG. 4A.

The translation displacement of the sleeve 32 is controlled by the piston 26B of the thermostat-controlled element 26. To achieve this, the inside of the sleeve 32 is integral with a bridge 38 to support the free end of the piston 26B. More precisely, this support bridge delimits a blind housing 38A for reception and support of the free end of the piston 26B.

Figure 5A:
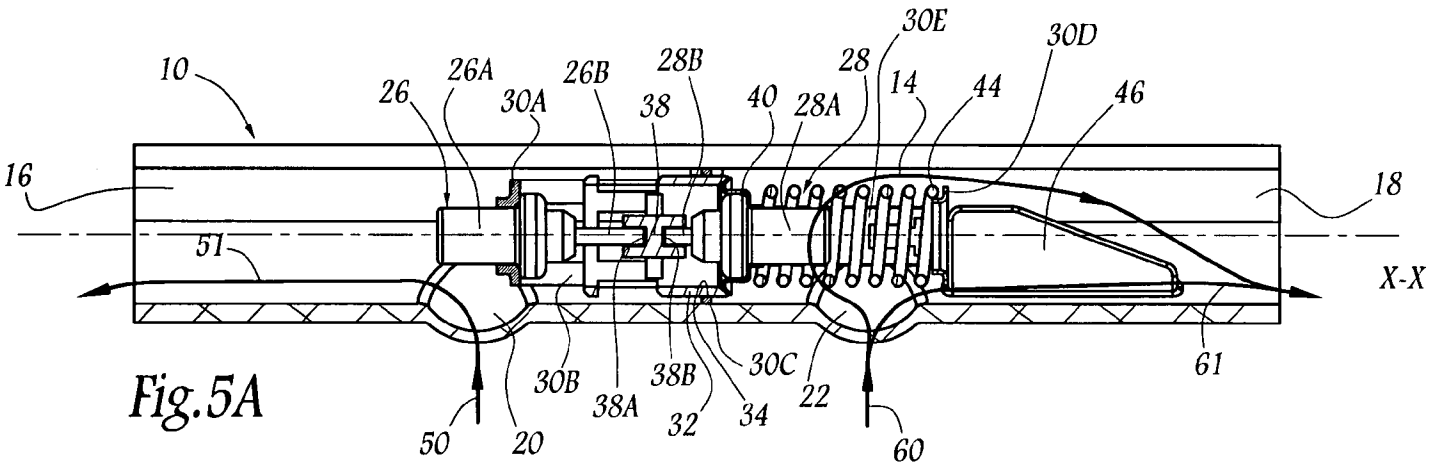
Figure 6A:
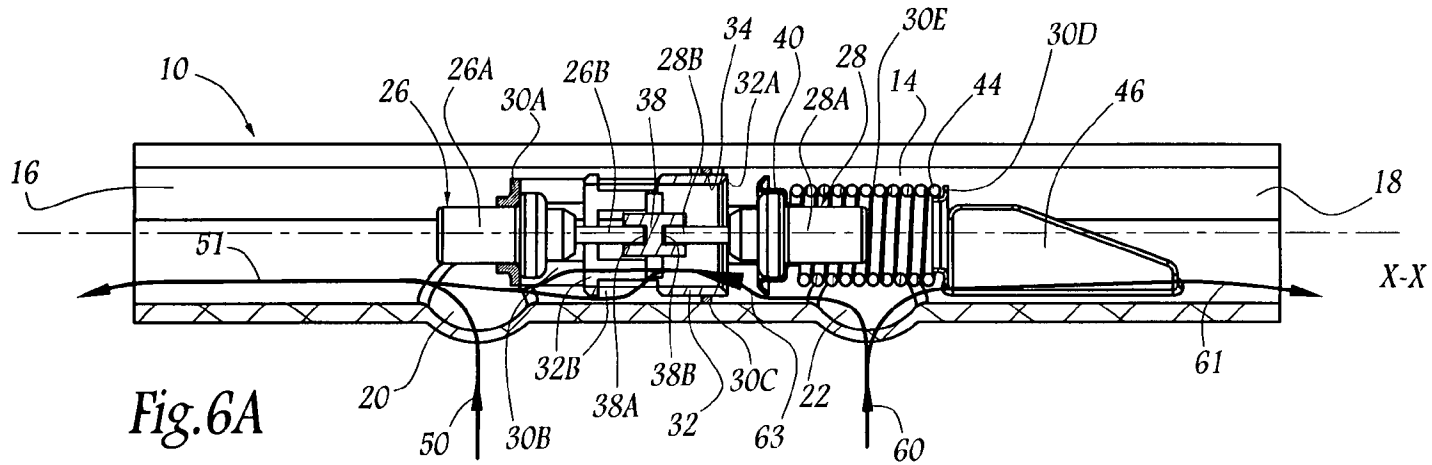

On the side axially opposite the piston 26B, the support bridge 38 delimits a second blind housing 38B into which the free end of the piston 28B of the second thermostat-controlled element 28 fits. The body 28A of this element 28 is rigidly connected to a valve 40, for example by being force fitted into a central opening in this valve. The outer ring of the valve 40 is shaped to bear in a sealed manner in contact with the free end edge 32A of the sleeve 32, facing the inlet 22 forming a seat. During operation, when the valve 40 is axially remote from the edge 32A as shown in FIG. 6A, fluid can flow freely through the chamber 14 between the outlets 16 and 18 passing inside the tubular sleeve 32, the partition of the sleeve being perforated in several areas 32B at the parts of the sleeve that are not intended to come into contact with the seat 34 during operation. The above-mentioned fluid flow is cut off when the valve 40 is bearing in contact with the edge 32A, as shown in FIG. 5A.

As shown in FIGS. 2 and 3A, the thermostat-controlled assembly 24 also comprises a compression spring 44 axially inserted between the valve 40 and an annular ring 30D of the stirrup 30 that is arranged at the free end of a pair of arms 30E of the stirrup, between which the body 28A of the element 28 made of the same material extends along a direction parallel to the X-X axis and globally axially in line with the arms 30E, from the transverse plate 30C. This ring 30D is designed to resist the thrust force applied by the spring 44 onto the arms 30E when they operate in tension, as long as the thermostat-controlled assembly 24 is not assembled to the casing 12. Once this assembly has been made, the ring 30D bears axially in contact with bearing parts 46 fixed to the casing 12, for example made of the same material as the inside wall of the casing. During operation, the ring 30D and these bearing parts 46 cooperate to resist the forces applied by the spring 44, the bearing parts relieving the arms 30E to resist most of these forces in compression.

The spring 44 is designed to bring each body 26A, 28A and each piston 26B, 28B of the elements 26 and 28 towards each other, after this body and this piston have moved away from each other due to the expansion of material contained in the body. The spring 44 is also adapted to keep the valve 40 in leak tight contact with the end edge 32A of the sleeve 32 as long as the piston 28B of the element 28 is not sufficiently extended with respect to its body 28A to push this body to resist the thrust applied by the spring.

We will now describe operation of this circuit 1 and the valve 10, giving details of circulation of cooling fluid within this circuit and this valve when the engine 4 is started and as it progressively builds up load.

Initially, when the engine 4 has been stopped for some time so that its temperature is substantially equal to the ambient temperature, the valve 10 is in the configuration in FIG. 3A, in other words with pistons 26B and 28B retracted to the maximum inside their associated bodies 26A, 28A.

When the engine 4 starts, the pump 3 draws out fluid at the outlet 9 from the radiator 2 and circulates it in circuit 1, by firstly sending it to the EGR system 5 and secondly to the engine 4. Since the engine is "cold", in other words its temperature is relatively close to ambient temperature, the cooling fluid at the outlet from the engine 4 is sent directly to the pump 3, through the valve 7, without supplying the inlet 8 to the radiator 2. In other words, the fluid flow at the inlet 22 to the valve 10 is zero.

As explained above, when the engine 4 starts, it is desirable that the temperature of the exhaust gases injected by the EGR system 5 into the engine 4 should be as low as possible to prevent the generation of thermal stresses between the hot exhaust gas intake manifold and the remainder of the relatively cold engine 4. In practice, during this engine start-up phase, the cooling fluid circulating in the EGR system 5 must be as cold as possible. To achieve this, after the cooling fluid has passed through the system 5, it is sent to the radiator 2 at its inlet 6 as shown by arrow 50 in FIGS. 3A and 3B. It enters the chamber 14 of the valve 10 through the inlet 20 and flows firstly freely to the outlet 16 as shown by the arrow 51, to supply the radiator compartment 2A (arrow 52), and secondly to the other outlet 18 of the valve 10 by passing along the outside of the sleeve 32 in the axial direction until it has gone past the seat 34 not closed off by the sleeve, as shown by the arrow 53. On the downstream side of the outlet 18, the fluid supplies the compartment 2B of the radiator 2 (arrow 54).

Thus, during the start-up phase of the engine 4, all fluid from the EGR system 5 is cooled by the two compartments 2A and 2B of the radiator 2, the fluid heat exchange surface in the radiator 2 thus being maximum.

Figure 3B:
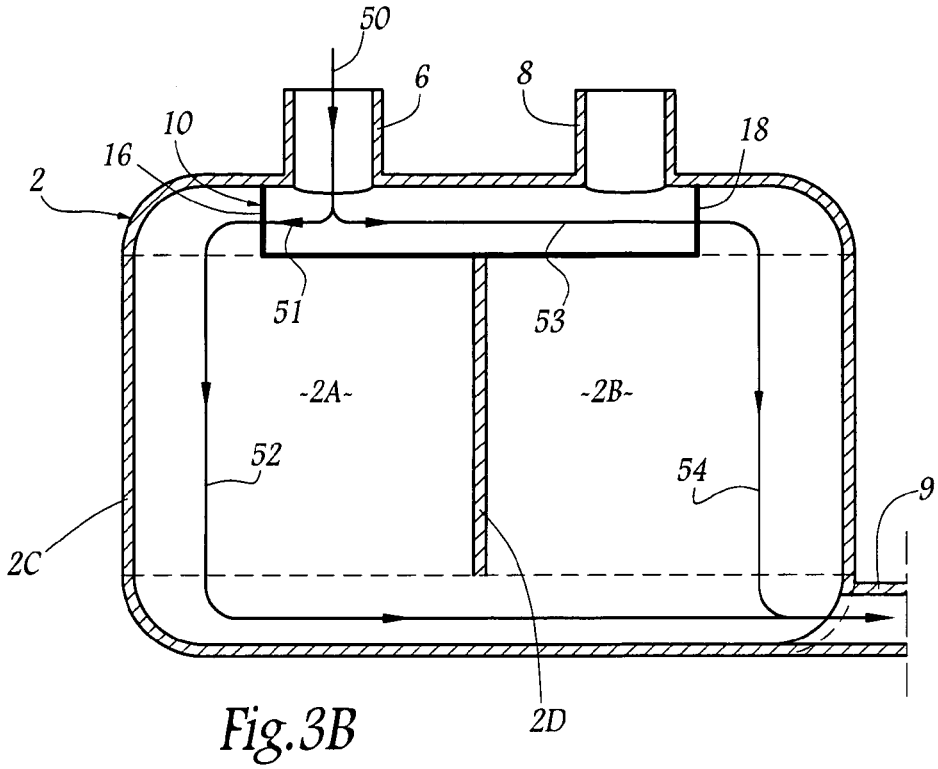
FIGS. 3B, 4B, 5B and 6B are diagrammatic views similar to FIG. 1, of a part of the circuit in FIG. 1 showing fluid circulation corresponding to FIGS. 3A, 4A, 5A and 6A respectively.
Figure 4B:
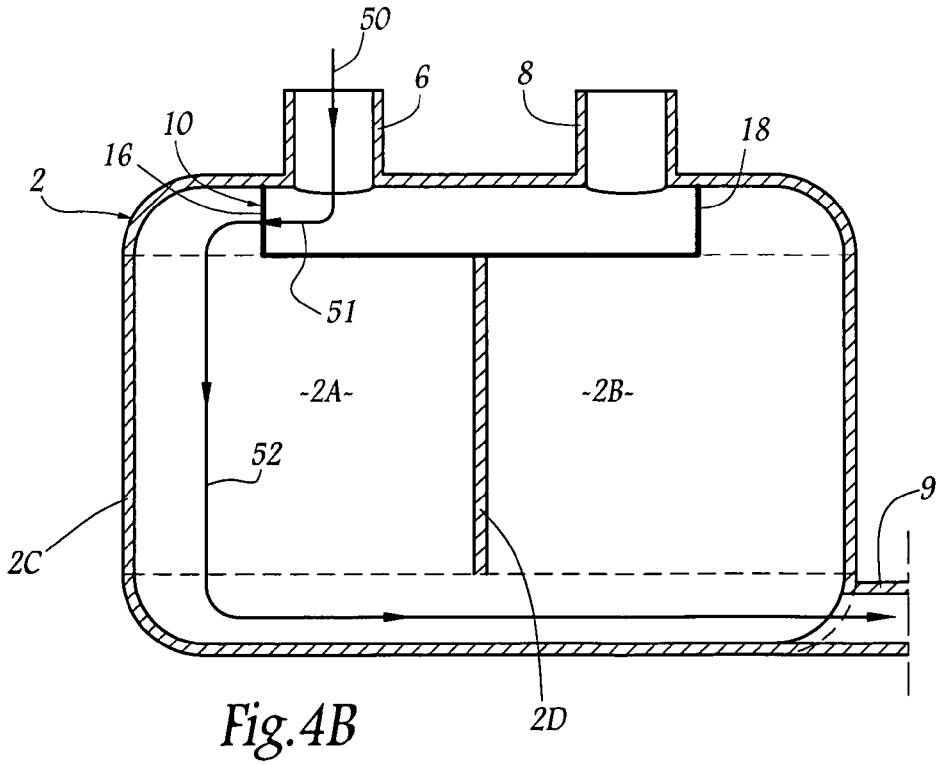

The engine 4 warms up progressively and the temperature of the cooling fluid circulating in the circuit 1 rises until it reaches a first temperature threshold value subsequently denoted $\theta_1$, at which the fluid flow through the chamber 14 between the inlet 20 and the outlet 18 is interrupted by the sleeve 32. For example, $\theta_1$ is equal to about 36° C. More precisely, as shown in FIGS. 4A and 4B, when the fluid inlet into the chamber 14 through the inlet 20 warms up, it causes expansion of the material contained in the body 26A of the thermostat-controlled element 26, which forces the piston 26B to extend towards the outlet 18. The free end of this piston 26B then bears in the axial direction on the bridge 38 and correspondingly pulls the sleeve 32 in axial translation towards the outlet 18, until this sleeve bears on the seat 34 in the radial direction. When the temperature of the fluid thus entering the valve 10 reaches the temperature $\theta_1$, the sleeve 32 hermetically closes off the seat 34 and the flow shown by the arrow 53 in FIGS. 3A and 3B is interrupted. In this configuration, fluid inlet through the inlet 6 into the radiator (arrow 50) is entirely sent into the compartment 2A of the radiator 2, along the flow shown by arrows 51 and 52, firstly through the inlet 20, then through the end of the chamber 14 and then through the outlet 16. The compartment 2B is no longer used. This operating state corresponds to a lower cooling need for the EGR system 5, the engine 4 having a sufficiently high temperature so that more moderate cooling of the exhaust gases is preferable. Thus, the energy consumption at the radiator 2 is less than the consumption corresponding to FIGS. 3A and 3B.

Figure 5B:
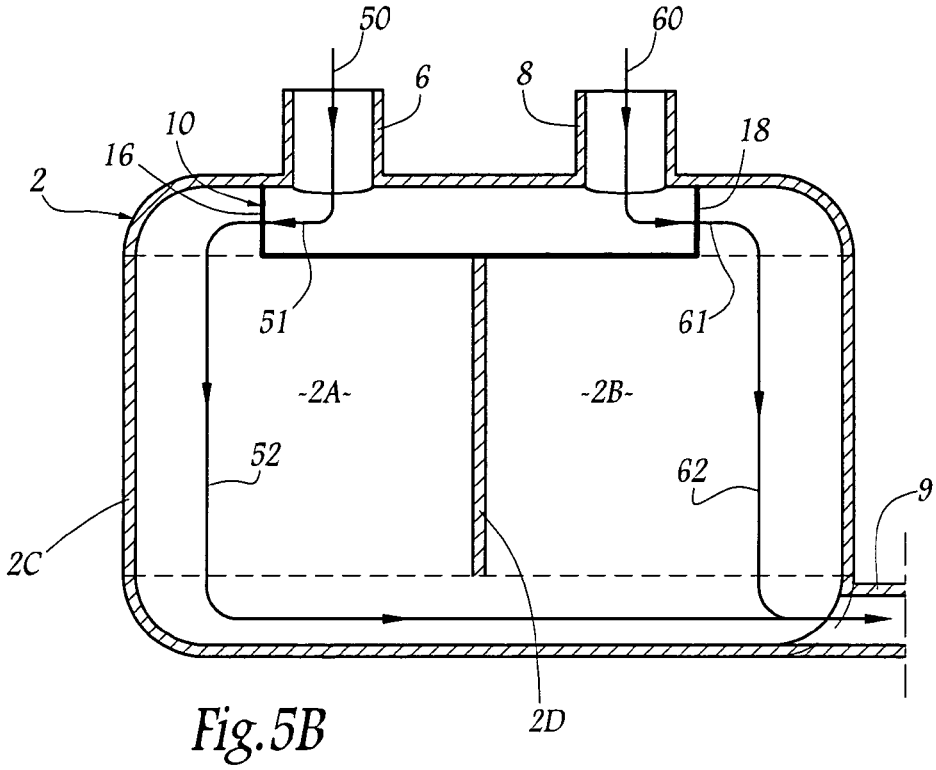

Subsequently, as the engine 4 continues to warm up, it becomes necessary to cool it. The valve 7 then controls the fluid inlet from the engine at the inlet 8 to the radiator 8. This fluid thus supplies the valve 10 at its inlet 22 as shown by the arrow 60 in FIGS. 5A and 5B. This fluid thus flows freely as far as the outlet 18 from valve 10 as shown by the arrow 61, and supplies the compartment 2B of the radiator 2 as shown by the arrow 62, and the fluid is cooled in this compartment. It should be noted that the temperature of the fluid inlet into the valve 10 through the inlet 6 has increased between FIGS. 4A and 5A, such that the piston 26B of the thermostat-controlled element 26 continued to extend from its body 26A.

Figure 6B:
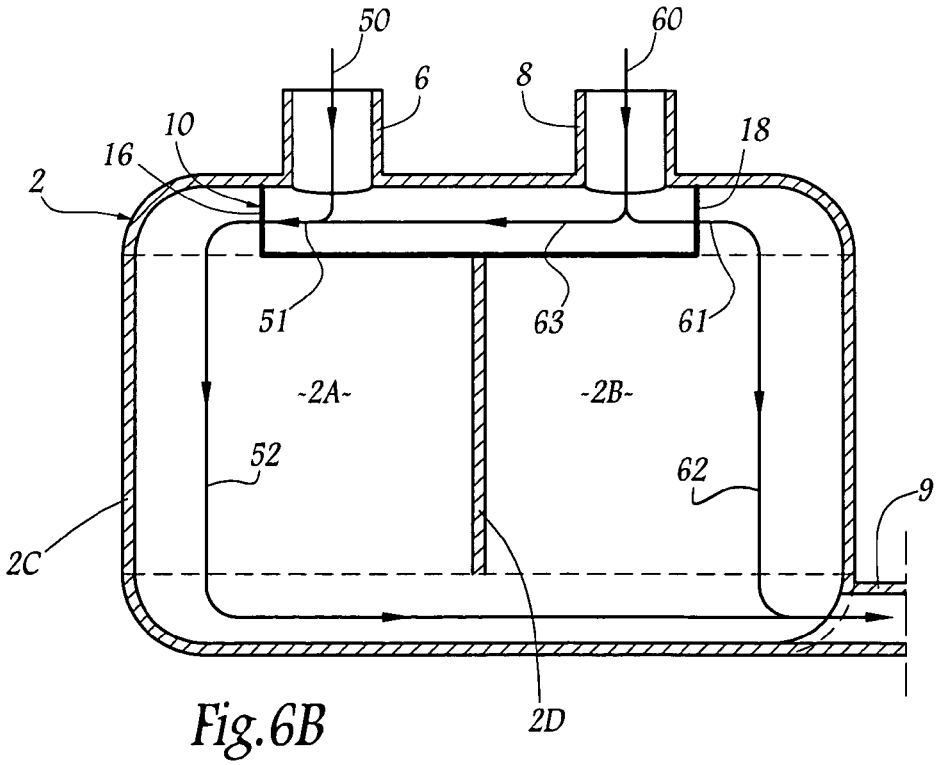

When a high load is applied to the engine 4, in other words for example on steep hills or in hot weather, the cooling capacity of the fluid in compartment 2B may be insufficient to efficiently cool the engine. In this case, the temperature of the fluid outlet from the engine increases until it reaches the second temperature threshold subsequently referred to as $\theta_2$, at which the valve 10 enables fluid flow between the inlet 22 and the outlet 16 through the chamber 14. For example, $\theta_2$ is equal to about 93° C. More precisely, as shown in FIGS. 6A and 6B for which the temperature of the inlet fluid is greater than the temperature $\theta_2$, the temperature rise of the temperature-sensitive part of the body 28A of the thermostat-controlled element 28 causes extension of its piston 28B which requires axial translation of the body 28B with respect to the thrust bridge 38 and consequently an axial separation of the valve 40 from the end edge 32A of the sleeve 32. Fluid then flows between the inlet 22 and the outlet 16, through the chamber 14, as shown by arrow 63. This flow radially bypasses the valve 40 and penetrates inside the sleeve 32, from where it is directed through the perforated zones 32B of the sleeve to reach the outlet 16. This fluid then mixes with the fluid inlet at the inlet 6 (arrow 50) and supplies the other compartment 2A of the radiator 2 (arrow 51) to be cooled in this compartment. In this configuration, the fluid supplying the valve 10 at its inlet 8 is sent to the two compartments 2A and 2B of the radiator 2, so that the maximum cooling capacity of this radiator can thus be used.

It should be noted that the fluid flow circulating inside the sleeve 32 in FIG. 6A is significantly greater than the fluid flow around this sleeve in FIG. 3A, for example by a factor of 10. In this way, the internal arrangement of the valve 10 is designed to take account of the significantly different fluid flows circulating firstly through the engine 4, and secondly through the EGR system 5.

Subsequently, when the temperature of the fluid entering the valve 10 drops, the spring 44 successively returns the valve body 28A of the thermostat-controlled element 28 with respect to its piston 28B, and then if the temperature drops further and the valve 40 returns to bearing in contact with the sleeve 32, the piston 26B of the thermostat-controlled element 26 returns towards its body 26A until it reaches the configuration shown in FIG. 3A when the engine 4 is stopped and is completely cold.

Use of the stirrup 30 provides a means of maintaining the thermostat-controlled assembly 24, in other words the thermostat-controlled elements 26 and 28 and the spring 44 in its configuration shown in FIGS. 2 and 3A before being assembled to the housing 12. This assembly essentially consists of adding the stirrup fitted with this assembly, by inserting the plate 30C into the slides 36 of the housing 12 as explained above. In one variant not shown, the thermostat-controlled assembly 24 is added directly into the chamber 14 of the housing 12, the partition delimiting this chamber then being provided both with a means of immobilising the body 26A of the thermostat-controlled element 26, similar to the ring 30A, and delimiting a seat to be closed off by the sleeve 32, similar to the seat 34 delimited by the through opening formed in the plate 30C.

Various arrangements and variants of the circuit and the valve described above are also possible. In particular, the arrangement of the inlets 20, 22 and outlets 16, 18 of the valve 10 may be modified, particularly as a function of the geometry of the radiator 2 and the location of this valve within this radiator.

The invention claimed is:

1. Thermostat controlled fluid regulation valve, comprising:

a housing delimiting a fluid circulation chamber inside the housing, the fluid chamber including a first fluid inlet at a first temperature, a second fluid inlet at a second temperature, and a first fluid outlet and a second fluid outlet through which fluid can freely communicate with the first and second inlets respectively, independently of the first and second temperatures, and thermostat-controlled means for controlling fluid circulation through the chamber, adapted firstly so that fluid can freely pass through the chamber between the first inlet and the second outlet and between the second inlet and the first outlet when either the value of the first temperature is less than a first predetermined threshold value, or the value of the second temperature is greater than a second predetermined threshold value strictly greater than the first threshold value, and secondly to prevent fluid from circulating through the chamber between the first inlet and the second outlet and between the second inlet and the first outlet when the value of the first temperature is greater than the first threshold value and also the value of the second temperature is less than the second threshold value.

2. Valve according to claim 1, wherein the thermostat-controlled means comprise two thermostat-controlled elements each comprising a body that contains an expandable material and a piston free to move with respect to the body under the effect of expansion of the material contained in the body, the body of a first of the two thermostat-controlled elements being arranged on the flow path of the fluid in the chamber between the first inlet and the first outlet, while the body of the second thermostat-controlled element is arranged on the flow path of the fluid in the chamber between the second inlet and the second outlet.

3. Valve according to claim 2, wherein each thermostat-controlled element carries a closer closing off the fluid passage through the chamber, the closer of the first thermostat-controlled element being associated with a seat rigidly connected to the housing while the closer of the second thermostat-controlled element is associated with another seat carried by the closer of the first thermostat-controlled element.

4. Valve according to claim 3, wherein the closer of the first thermostat-controlled element comprises a tubular sleeve around which fluid circulates when the value of the first temperature is strictly less than the first threshold value and inside which fluid circulates when the value of the second temperature is greater than the second threshold value.

5. Valve according to claim 4, wherein the closer of the second thermostat-controlled element comprises a valve disk adapted to bear on one of the end edges of the tubular sleeve.

6. Valve according to claim 3, wherein the body of the first thermostat-controlled element is fixed with respect to the housing, the closer carried by this first thermostat-controlled element being moved by its piston and in that the closer carried by the second thermostat-controlled element is fixed to the body of the second thermostat-controlled element, the position of the piston of this second thermostat-controlled element with respect to the housing being controlled by the piston of the first thermostat-controlled element.

7. Valve according to claim 6, wherein the closer of the first thermostat-controlled element is provided with a means of supporting the free end of each piston of the first and second thermostat-controlled elements.

8. Valve according to claim 3, wherein it comprises a single elastic device for pulling the body towards the piston of each thermostat-controlled element, this elastic device being adapted to force the closer carried by the second thermostat-controlled element in contact with its associated seat when the value of the second temperature is less than the second threshold value.

9. Cooling circuit for an internal combustion engine and a recirculation system for exhaust gases output from this engine, comprising a thermostat-controlled fluid regulation valve for the circuit, conforming with claim 1, and a radiator comprising a cooling body that delimits:

a first inlet connected to the first inlet of the valve and adapted to be supplied with fluid from the exhaust gases recirculation system, and a second inlet connected to the second inlet of the valve and adapted to be supplied with fluid from the thermal combustion engine, a fluid exhaust outlet, a first compartment for heat exchange with the fluid, opening up on the downstream side in the exhaust outlet and connected on the upstream side to the first outlet of the valve, and a second compartment for heat exchange with the fluid, separated from the first compartment by a cooling partition, opening up on the downstream side in an exhaust outlet and connected on the upstream side to the second outlet of the valve.

10. Circuit according to claim 9, wherein the housing of the valve is integrated inside the body of the radiator, and in particular is integral with at least a part of this body.

* * * * *